US008240868B1

(12) United States Patent
Sims

(10) Patent No.: US 8,240,868 B1
(45) Date of Patent: Aug. 14, 2012

(54) LOCKET WITH ILLUMINATION SOURCE

(76) Inventor: Michelle Sims, Lawrence, KS (US)

( * ) Notice: Subject to any disclaimer, the term of this patent is extended or adjusted under 35 U.S.C. 154(b) by 314 days.

(21) Appl. No.: 12/731,228

(22) Filed: Mar. 25, 2010

(51) Int. Cl.
*F21V 21/08* (2006.01)

(52) U.S. Cl. ..... 362/104; 362/103; 362/108; 63/19

(58) Field of Classification Search ..... 362/103, 362/104, 108; 63/18–19
See application file for complete search history.

(56) References Cited

U.S. PATENT DOCUMENTS

| | | | | |
|---|---|---|---|---|
| 3,937,320 | A | 2/1976 | Chao et al. | |
| 4,101,955 | A | 7/1978 | DuNah | |
| 6,816,438 | B1 | 11/2004 | Zeller | |
| 7,000,428 | B2 | 2/2006 | Kamara et al. | |
| 7,251,957 | B2 * | 8/2007 | Solomon | 63/19 |
| 7,325,940 | B2 | 2/2008 | Cea et al. | |
| 2006/0087833 | A1 | 4/2006 | Simoni | |

FOREIGN PATENT DOCUMENTS

| | | | |
|---|---|---|---|
| EP | 260048 | A1 * | 3/1988 |

* cited by examiner

*Primary Examiner* — Robert May

(57) ABSTRACT

A locket with an illumination source utilized in combination with a neck chain. The locket includes an upper member containing a battery-operated illumination source such as a LED, a lower member including an open button and a clip receptacle, and a hinge, preferably a ratcheting-type hinge, connecting the upper member and the lower member. The open button disengages a locking clip disposed in the upper member from the clip receptacle to open the locket and can be in operational communication with the light emitting diode to activate the light emitting diode when the locket is in any open position. An aperture in the hinge removably slidably receives a neck chain therethrough. The ratcheting type first hinge selectively temporarily locks the locket in a selected open position. The locket also includes a magnifying glass pivotally disposed between an upper member and a lower member of the locket.

10 Claims, 5 Drawing Sheets

LOCKET WITH ILLUMINATION SOURCE

BACKGROUND OF THE INVENTION

Various types of illumination devices are known in the prior art. However, what is needed is a locket with an illumination source including a first hinge which is a ratcheting type hinge for securing the illumination source in various positions and which is worn on a neck chain and also including a magnifying glass pivotally disposed between an upper member and a lower member of the locket.

FIELD OF THE INVENTION

The present invention relates to illumination devices, and more particularly, to a locket with an illumination source.

SUMMARY OF THE INVENTION

In view of the aforestated known types of locket with an illumination sources now present in the prior art, the general purpose of the present locket with an illumination source, described subsequently in greater detail, is to provide a locket with an illumination source which has many novel features that result in a locket with an illumination source which is not anticipated, rendered obvious, suggested, or even implied by prior art, either alone or in combination thereof.

To accomplish this, the present locket with an illumination source is preferably utilized in combination with a neck chain. The locket includes an upper member, a lower member, and a first hinge connecting the upper member and the lower member. The locket includes a battery-operated illumination source, which is preferably a light emitting diode, disposed within the upper member. A locking clip is disposed proximal to a top edge of an interior wall of the upper member. An open button disposed on an exterior wall of the upper member is in operational communication with the locking clip. The open button can be in operational communication with the light emitting diode to activate the light emitting diode when the locket is in any open position The lower member includes a clip receptacle which removably secures the locking clip. The open button selectively disengage the locking clip from the clip receptacle. A battery compartment is also contained within the lower member. The first hinge has an aperture therethrough which removably slidably receives a neck chain therethrough. The first hinge is preferably a ratcheting type hinge whereby the hinge selectively temporarily locks the locket in a selected open position.

The present locket may also include a thin pivotally attached magnifying glass about the same size as the lower member, the magnifying glass being disposed between the inside wall of the lower member and the interior wall of the upper member. A clip receiver having an opening center therein, which is aligned with the clip receptacle, is disposed on an upper surface of the magnifying glass above the clip receptacle. The locking clip thus removably engages both the clip receiver and the clip receptacle. A small raised lip member disposed on the upper surface of the magnifying glass proximal to the first hinge provides a grip surface to lift the magnifying glass away from the lower member and pivoting the magnifying glass outwardly. The magnifying glass provides an enlarged visual detail of an area upon which the user is focusing activity. The second hinge may also be a ratcheting type hinge to selectively temporarily lock the magnifying glass in a selected open position. The raised lip member is small to maximize an area for viewing through the magnifying glass.

Because the present locket does not have to be hand-held by the user, the present locket allows a user involved in an activity, such as knitting, crochet, needlepoint or reading, the use of both hands, while also directing light, by utilizing the ratcheting first hinge, upon the particular activity without disturbing other individuals. The present locket is great for shedding light on personal activities while traveling in a vehicle or on an airplane. The present locket does not have to be attached to the object upon which light is desired to be directed, as does a standard book light which is typically attached to the book being read or as does a ball cap light which must be attached to a hat visor to work properly.

The present locket with illumination source may be formed of molded plastic, such as polystyrene, ABS, or polypropoylene, or any sturdy metal. Further, the present locket may be made formed in a variety of colors, shapes, and styles. The present locket could even be formed to create a collectible or heirloom type piece of jewelry.

Thus has been broadly outlined the more important features of the present locket with an illumination source and method so that the detailed description thereof that follows may be better understood and in order that the present contribution to the art may be better appreciated.

Numerous objects, features and advantages of the present locket with an illumination source will be readily apparent to those of ordinary skill in the art upon reading the following detailed description of presently preferred, but nonetheless illustrative, examples of the present locket with an illumination source and method when taken in conjunction with the accompanying drawings. In this respect, before explaining the current examples of the present locket with an illumination source and method in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the locket with an illumination source and method. It is therefore important that the claims be regarded as including such equivalent constructions insofar as they do not depart from the spirit and scope of the present invention.

Objects of the present locket with an illumination source and method, along with various novel features that characterize the invention are particularly pointed out in the claims forming a part of this disclosure. For better understanding of the locket with an illumination source and method, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
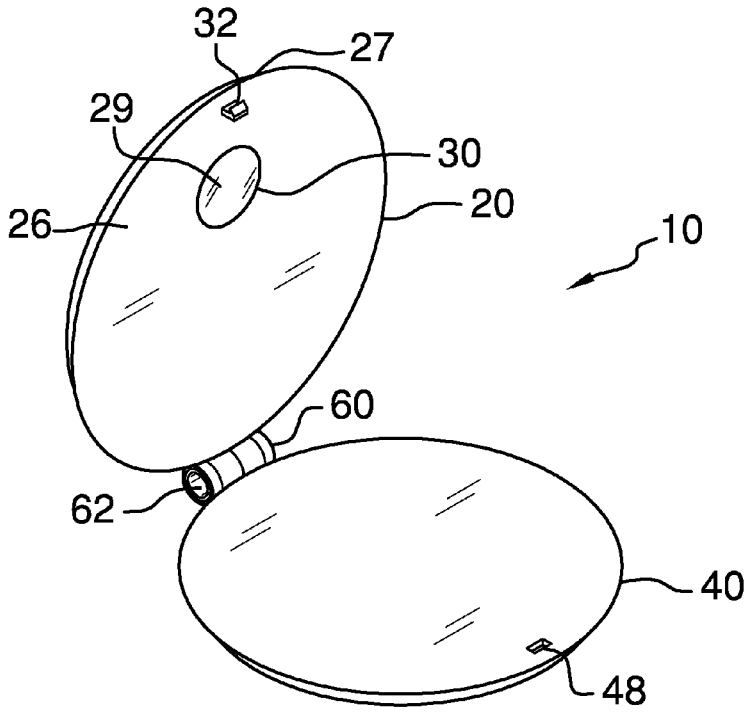
FIG. 1 is an isometric view of the present locket with an illumination source in an open position.
Figure 2:
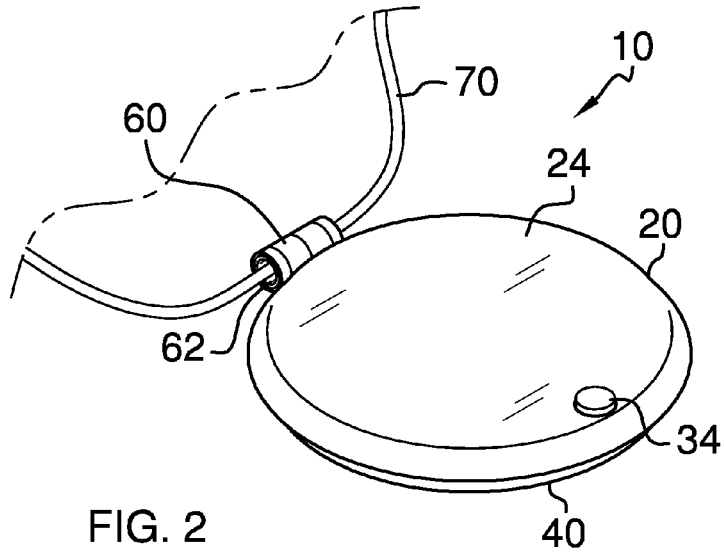
FIG. 2 is an isometric view thereof in a closed position mounted on a neck chain.
Figure 3:
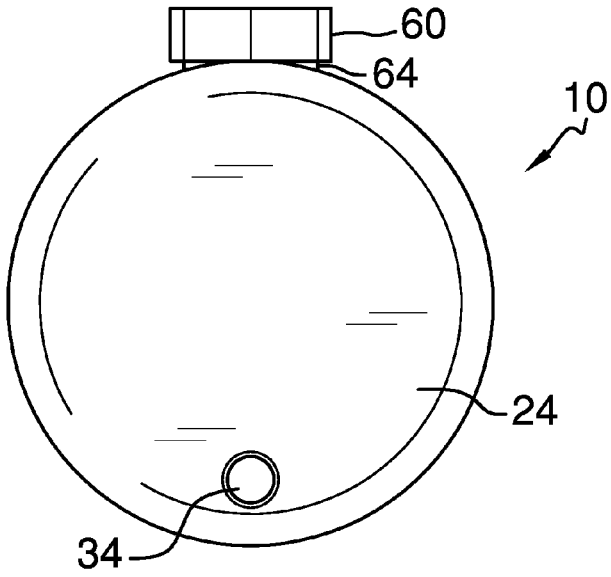
FIG. 3 is a front elevation view thereof.
Figure 4:
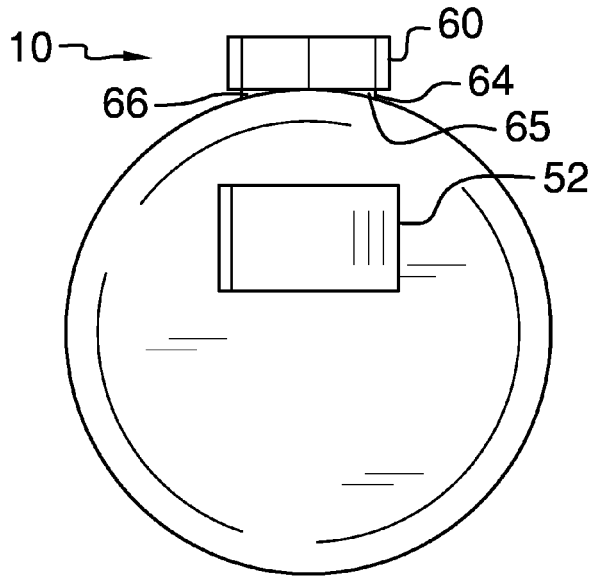
FIG. 4 is a rear elevation view thereof.
Figure 5:
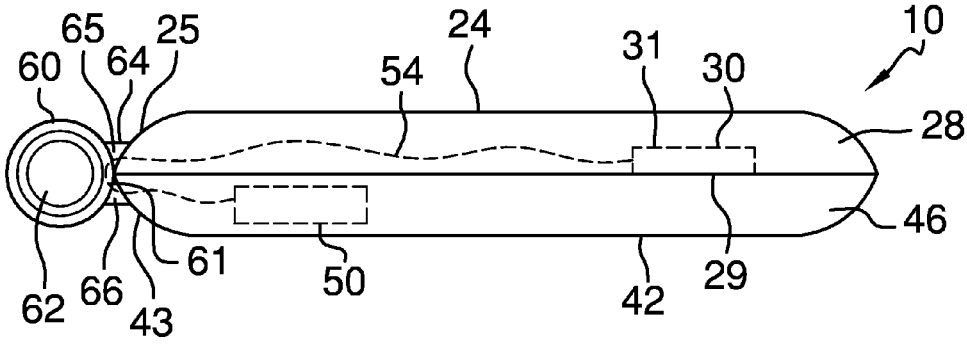
FIG. 5 is right elevation view; the opposite side being a mirror image thereof.

With reference now to the drawings, and in particular FIGS. 1 through 8 thereof, example of the instant locket with an illumination source employing the principles and concepts of the present locket with an illumination source and generally designated by the reference number 10 will be described.

Referring to FIGS. 1 through 8 the present locket with an illumination source 10 is illustrated. The locket with an illumination source 10 is preferably utilized in combination with a neck chain 70. The locket 10 includes an upper member 20, a lower member 40, and a first hinge 60 connecting the upper member 20 and lower member 40 to one another. The locket 10 has an exterior wall 24 having a rear end 25, an interior wall 26 opposite the exterior wall 24 and a first cavity 28 disposed between the exterior wall 24 and the interior wall 26. The locket 10 also includes a battery-operated illumination source 30 having a front side 29 and a rear side 31. The front side 28 is disposed on the interior wall 26. The illumination source 10 is disposed within the first cavity 28.

A locking clip 32 is disposed proximal to a top edge 27 of the interior wall 26. An open button 34 is disposed on the exterior wall 24. The open button 34 is in operational communication with the locking clip 32.

The lower member 40 has about the same dimensions as the upper member 20. The lower member 40 is in operational communication with the upper member 20. The lower member 40 includes an outside wall 42, an inside wall 44 opposite the outside wall 42, and a second cavity 46 disposed between the outside wall 42 and the inside wall 44.

A clip receptacle 48 is disposed in the inside wall 44. The clip receptacle removably secures the locking clip 32. The open button 34 selectively disengages the locking clip 32 from the clip receptacle 48. A battery compartment 50 having an access door 52 is contained within the second cavity 46. The access door 52 is disposed on the outside wall 42. Wiring 54 runs between the illumination source 30 and batteries (not shown) contained in the battery compartment 50 to provide a power source to the illumination source 30.

The locket 10 first hinge 60 has a front end 61 and a pivotable connection member 64 having a first side 65 and an opposite second side 66. The first side 65 is attached to the front end 61 of the first hinge 60 and to the rear end 25 of the upper member 20 exterior wall 24. The second side 66 of the connection member 64 is attached to the front end 61 of the first hinge 60 and to the rear end 25 of the lower member 40 exterior wall 24. An aperture 62 continuously runs along a central longitudinal axis of the first hinge 60. The aperture 62 removably slidably receives a neck chain 70 therethrough. The first hinge 60 is preferably a ratcheting type hinge whereby the first hinge 60 selectively temporarily locks the locket 10 in a selected open position. Further, the illumination source 30 is preferably a light emitting diode which is disposed proximal to the top edge 27 of the interior wall 26 closer to the first hinge 60 than the locking clip 32.

The open button 34 can be in operational communication with the light emitting diode to activate the light emitting diode when the locket 10 is in any open position.

Figure 6:
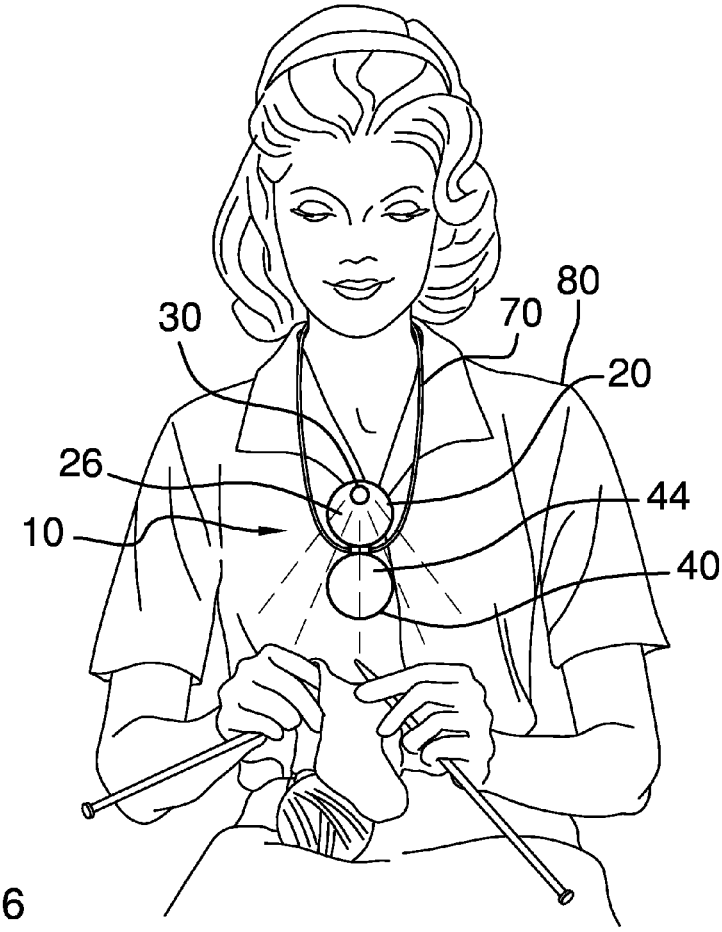
FIG. 6 is an in-use view.
Figure 7:
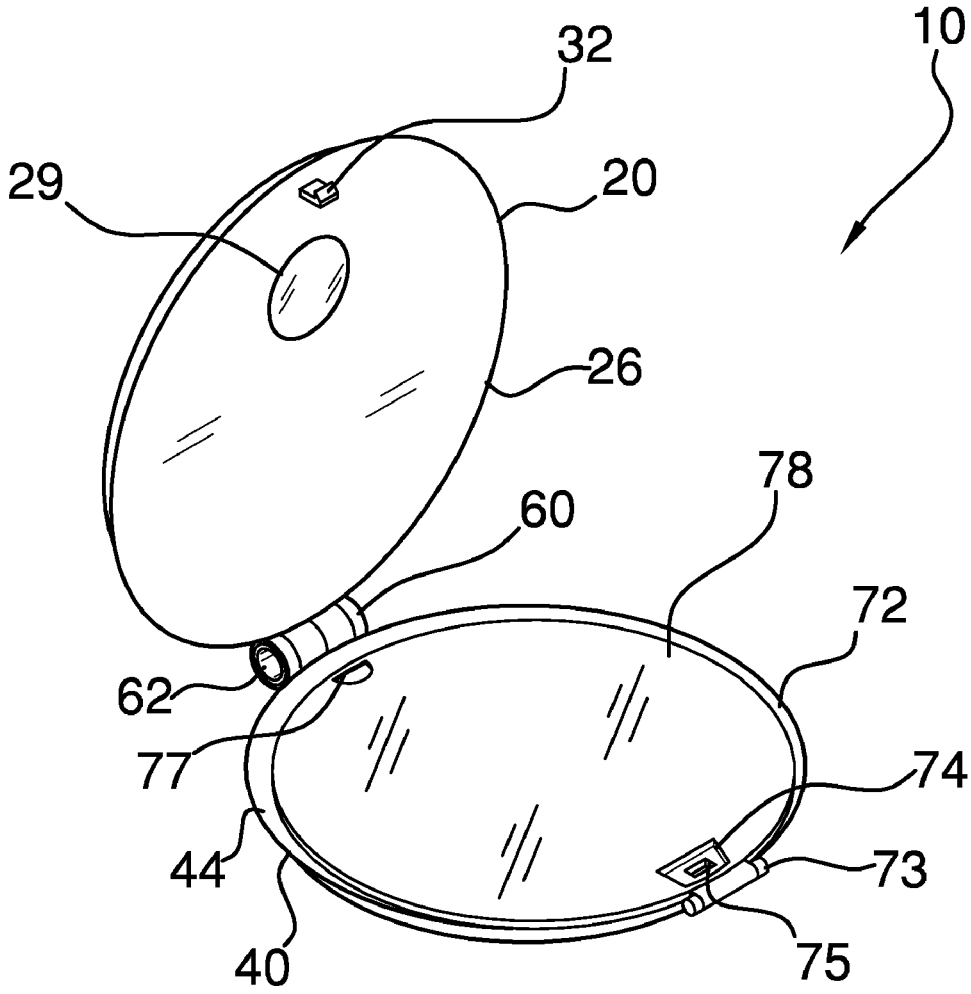
FIG. 7 is an isometric view thereof with a magnifying glass.
Figure 8:
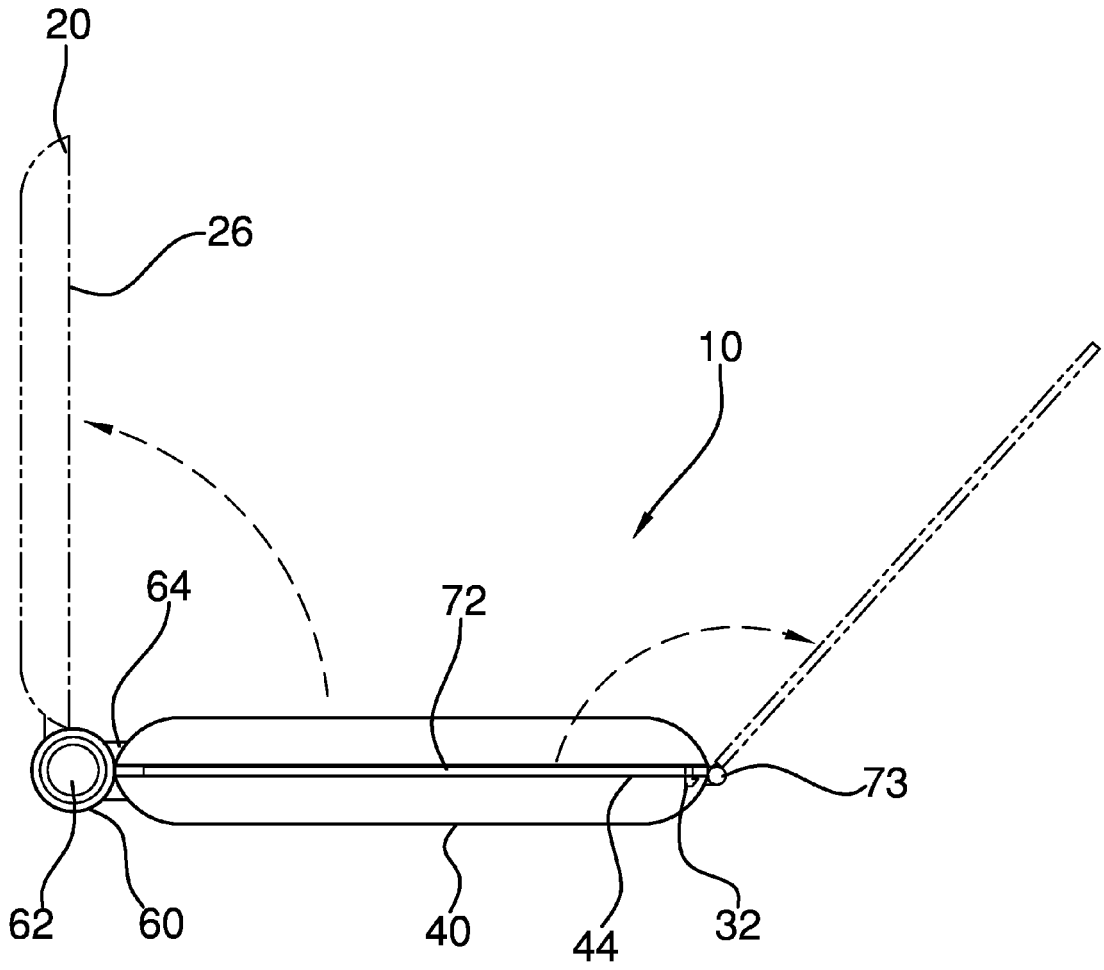
FIG. 8 is a right elevation view thereof with a magnifying glass.

Because the present locket 10 does not have to be handheld by the user 80, the present locket 10 allows a user 80 involved in an activity, such as knitting (as shown in FIG. 6), crochet, needlepoint or reading, the use of both hands, while also directing light upon the activity without disturbing other individuals by utilizing the first hinge 60.

The present locket 10 may also include a thin magnifying glass 72 disposed between the inside wall 44 of the lower member 40 and the interior wall 26 of the upper member 20. The magnifying glass 72 is about the same size as the lower member 40. A second hinge 73 is attached to the lower member 40 opposite the first hinge 60 proximal to the clip receptacle 48. A clip receiver 74 is disposed on an upper surface 78 of the magnifying glass 72 above the clip receptacle 48. An opening 75 centered in the clip receiver 74 aligns with the clip receptacle 48. The locking clip 32 removably engages both the clip receiver 74 and the clip receptacle 48. The magnifying glass 72 pivotally engages the second hinge 73 outwardly from the lower member 40. A small raised lip member 77 is disposed on the upper surface 78 of the magnifying glass 72 proximal to the first hinge. The lip member 77 provides a grip surface to lift the magnifying glass 72 away from the lower member 40 and pivoting the magnifying glass 72 outwardly. The clip receiver 74 is disposed above the magnifying glass 72. The magnifying glass 72 provides an enlarged visual detail of an area upon which the user 80 is focusing activity. The second hinge 73 may also be a ratcheting type hinge to selectively temporarily lock the magnifying glass in a selected open position. The raised lip member 77 is small to maximize an area for viewing through the magnifying glass 72.

With respect to the above description then, it is to be realized that the optimum dimensional relationships for the parts of the present locket with an illumination source to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A locket with an illumination source in combination with a neck chain, the locket comprising:

an upper member comprising an exterior wall;

an interior wall opposite the exterior wall;

a first cavity disposed between the exterior wall and the interior wall;

a battery-operated illumination source having a front side and a rear side, the front side disposed on the interior wall, the illumination source disposed within the first cavity;

a locking clip disposed proximal to a top edge of the interior wall;

an open button disposed on the exterior wall, the open button in operational communication with the locking clip;

a lower member having about the same dimensions as the upper member, the lower member in operational communication with the upper member, the lower member comprising an outside wall;

an inside wall opposite the outside wall;

a second cavity disposed between the outside wall and the inside wall;

a clip receptacle disposed in the inside wall, the clip receptacle removably securing the locking clip;

wherein the open button selectively disengages the locking clip from the clip receptacle;

a battery compartment having an access door thereto, the battery compartment contained within the second cavity, the access door disposed on the outside wall;

a first hinge having a front end, the first hinge comprising a pivotable connection member having a first side and an opposite second side, the first side attached to the front end of the first hinge and to the rear end of the upper member exterior wall, the second side attached to the front end of the first hinge and to the rear end of the lower member exterior wall;

an aperture continuously running along a centered longitudinal axis of the first hinge, the aperture removably slidably receiving a neck chain therethrough.

2. The locket with an illumination source of claim 1 wherein the first hinge is a ratcheting type hinge whereby the first hinge selectively temporarily locks the locket in a selected open position.

3. The locket with an illumination source of claim 2 wherein the illumination source is a light emitting diode.

4. The locket with an illumination source of claim 3 wherein the light emitting diode is disposed proximal to the top edge of the interior wall closer to the first hinge than the locking clip.

5. A locket with an illumination source in combination with a neck chain, the locket comprising:

an upper member comprising an exterior wall;

an interior wall opposite the exterior wall;

a first cavity disposed between the exterior wall and the interior wall;

a battery-operated light emitting diode having a front side and a rear side, the front side disposed on the interior wall, the light emitting diode disposed within the first cavity;

a locking clip disposed proximal to a top edge of the interior wall;

an open button disposed on the exterior wall, the open button in operational communication with the locking clip;

a lower member having about the same dimensions as the upper member, the lower member in operational communication with the upper member, the lower member comprising an outside wall;

an inside wall opposite the outside wall;

a second cavity disposed between the outside wall and the inside wall;

a clip receptacle disposed in the inside wall, the clip receptacle removably securing the locking clip;

wherein the open button selectively disengages the locking clip from the clip receptacle;

a battery compartment having an access door thereto, the battery compartment contained within the second cavity, the access door disposed on the outside wall;

a first hinge having a front end, the first hinge comprising a pivotable connection member having a first side and an opposite second side, the first side attached to the front end of the first hinge and to the rear end of the upper member exterior wall, the second side attached to the front end of the first hinge and to the rear end of the lower member exterior wall;

an aperture continuously running along a centered longitudinal axis of the first hinge, the aperture removably slidably receiving a neck chain therethrough;

wherein the open button is further in operational communication with the light emitting diode;

wherein the light emitting diode is activated upon placing the locket in an open position.

6. The locket with an illumination source of claim 5 wherein the first hinge is a ratcheting type hinge whereby the first hinge selectively temporarily locks the locket in a selected open position.

7. The locket with an illumination source of claim 6 wherein the light emitting diode is disposed proximal to the top edge of the interior wall closer to the first hinge than the locking clip.

8. The locket with an illumination source of claim 6 wherein the light emitting diode is disposed proximal to the top edge of the interior wall closer to the first hinge than the locking clip.

9. The locket with an illumination source of claim 5 wherein the first hinge and the second hinge are a ratcheting type hinges whereby the first hinge and the second hinge selectively temporarily lock each of the locket and the magnifying glass, respectively, in a selected open position.

10. A locket with an illumination source in combination with a neck chain, the locket comprising:

an upper member comprising an exterior wall;

an interior wall opposite the exterior wall;

a first cavity disposed between the exterior wall and the interior wall;

a battery-operated light emitting diode having a front side and a rear side, the front side disposed on the interior wall, the light emitting diode disposed within the first cavity;

a locking clip disposed proximal to a top edge of the interior wall;

an open button disposed on the exterior wall, the open button in operational communication with the locking clip;

a lower member having about the same dimensions as the upper member, the lower member in operational communication with the upper member, the lower member comprising an outside wall;

an inside wall opposite the outside wall;

a second cavity disposed between the outside wall and the inside wall;

a clip receptacle disposed in the inside wall, the clip receptacle removably securing the locking clip;

wherein the open button selectively disengages the locking clip from the clip receptacle;

a battery compartment having an access door thereto, the battery compartment contained within the second cavity, the access door disposed on the outside wall;

a first hinge having a front end, the first hinge comprising a pivotable connection member having a first side and an opposite second side, the first side attached to the front end of the first hinge and to the rear end of the upper member exterior wall, the second side attached to the front end of the first hinge and to the rear end of the lower member exterior wall;

an aperture continuously running along a centered longitudinal axis of the first hinge, the aperture removably slidably receiving a neck chain therethrough;

wherein the open button is further in operational communication with the light emitting diode;

wherein the light emitting diode is activated upon placing the locket in an open position;

a magnifying glass disposed between the lower member inside wall and the upper member interior wall, the magnifying glass having a size about a size of the lower member;

a second hinge attached to the lower member opposite the first hinge proximal to the clip receptacle, the magnifying glass pivotally engaging the second hinge outwardly from the lower member;

a clip receiver disposed on a upper surface of the magnifying glass above the clip receptacle;

an opening centered in the clip receiver, the opening aligning with the clip receptacle;

wherein the locking clip removably engages both the clip receiver and the clip receptacle;

a small raised lip member disposed on the magnifying glass upper surface proximal to the first hinge, the lip member providing a gripping surface for lifting and pivoting the magnifying glass away from the lower member.

* * * * *